United States Patent [19]

Hughes

[11] Patent Number: 4,903,465

[45] Date of Patent: Feb. 27, 1990

[54] MOWER GUARD FOR FLEXIBLE MARKERS

[75] Inventor: Robert K. Hughes, Fort Meyers, Fla.

[73] Assignee: Flexstake, Inc., Azle, Tex.

[21] Appl. No.: 390,775

[22] Filed: Aug. 8, 1989

Related U.S. Application Data

[63] Continuation-in-part of Ser. No. 190,482, May 5, 1988, Pat. No. 4,862,823.

[51] Int. Cl.[4] ..... A01D 75/20; A01D 34/42; A01D 34/70

[52] U.S. Cl. ..... 56/12.7; 56/13.6; 56/17.4; 56/320.1; 56/320.2; 56/DIG. 2

[58] Field of Search ..... 56/17.4, 6, 13.6, 12.7, 56/255, 320.1, 320.2, DIG. 2, DIG. 24

[56] References Cited

U.S. PATENT DOCUMENTS

| | | | |
|---|---|---|---|
| 2,487,927 | 11/1949 | Isaacs | 56/17.4 |
| 2,711,067 | 6/1955 | Mott | 56/12.7 X |
| 2,934,882 | 5/1960 | Kaut . | |
| 3,116,583 | 1/1964 | Mason | 56/6 |
| 3,148,490 | 1/1963 | Chadwick . | |
| 3,481,124 | 12/1969 | Machovina . | |
| 3,665,693 | 5/1972 | Dacus et al. . | |
| 3,680,294 | 8/1972 | Dacus et al. . | |
| 3,715,875 | 2/1973 | Brucker | 56/320.1 |
| 3,797,213 | 3/1974 | Sadow, Jr. et al. | 56/17.4 X |
| 3,971,199 | 7/1976 | Buchele . | |
| 4,037,396 | 7/1977 | Buchele et al. . | |
| 4,211,060 | 7/1980 | Rhodes | 56/12.7 X |
| 4,216,643 | 8/1980 | Malone | 56/17.4 X |
| 4,769,976 | 9/1988 | Bassett et al. | 56/7 |

*Primary Examiner*—George A. Suchfield
*Attorney, Agent, or Firm*—James E. Bradley

[57] ABSTRACT

A mower has features that allow it to mow directly over a flexible marker shaft without damage to the shaft. The mower has front and rear rollers mounted directly in front and behind each blade. These rollers engage the ground in rolling contact and support the housing. The rollers are spaced together a distance less than the height of the marker. The front roller contacts the marker and causes it to bend over. Before the front roller leaves the marker, the rear roller will be in contact with the marker to keep it in a prone position until the mower passes from the marker.

15 Claims, 4 Drawing Sheets

MOWER GUARD FOR FLEXIBLE MARKERS

CROSS REFERENCE TO RELATED APPLICATIONS

This application is a continuation-in-part of application Ser. No. 190,482, filed May 5, 1988, now U.S. Pat. No. 4,862,823.

BACKGROUND OF THE INVENTION

1. Field of the Invention

This invention relates in general to equipment for mowing grass, and in particular to a lawn mower which is capable of mowing over flexible markers.

2. Description of the Prior Art

Large grassy areas that require mowing often have numerous obstacles. Markers are one type of obstacle. For example, on a golf course, markers and signs are used for tee boxes, out-of-bounds areas, hazards and distance indicators. Right-of-way areas next to highways also utilize various markers.

When cutting the grass, these markers have to be cut around or pulled up, then replaced. If cut around, the appearance will be unsightly and even can obscure the marker unless further trimming is done. This requires additional equipment and is time-consuming.

In application Ser. No. 190,482, filed May 5, 1988, a flexible shaft is disclosed for use in these areas. This shaft will bend at the point where it enters the ground to a position substantially flush with the ground. This allows a reel-type mower to mow directly over the marker. The mower blade contacts the marker and pushes it downward as the mower moves over it.

While the above-identified patent application describes a satisfactory method of use with reel-type mowers, there is no discussion of how such would work with other types of mowers. For example, with rotary mowers which use a blade that rotates in a horizontal plane, the blade would destroy the marker. Also, a flail-type mower which utilizes a number of cutting elements rotated around a horizontal shaft, would damage or destroy the marker. In addition, these types of mowers do not have any means for causing the marker to begin bending as the mower contacts it.

SUMMARY OF THE INVENTION

In this invention, mowers are fitted with front and rear guard members. Each guard member is a solid curved surface extending transversely across each blade. One of the guard members will be located in front of the blade and one in the rear. The front guard member causes the marker to bend and holds it down until the rear guard member begins to contact it. The spacing of the front and rear guard members is such that the rear guard member will be in a position to hold the stake down by the time the front guard member leaves the marker.

In the preferred embodiment, the guard members comprise cylindrical rotatable rollers. Also, preferably, each roller contacts the ground and supports the housing of the mower.

DETAILED DESCRIPTION OF THE INVENTION

Figure 1:
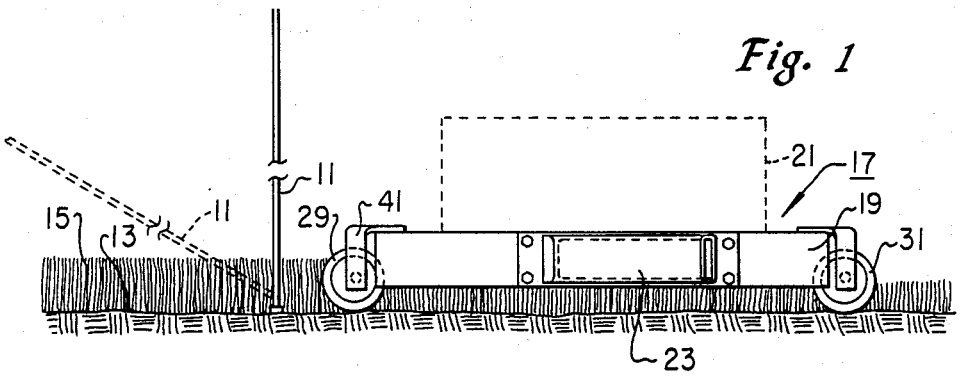
FIG. 1 is a schematic side elevational view illustrating a mower constructed in accordance with this invention, shown prior to contacting a marker.

Referring to FIG. 1, marker 11 is a stake or shaft driven into the ground 13. Marker 11 may have a sign, symbol or some other type of indication on it. Marker 11 is preferably of a type as shown in U.S. Pat. Application Ser. No. 190,482, filed May 5, 1988, all of which material is hereby incorporated by reference. Marker 11 may be located in an area having grass 15.

Figure 3:
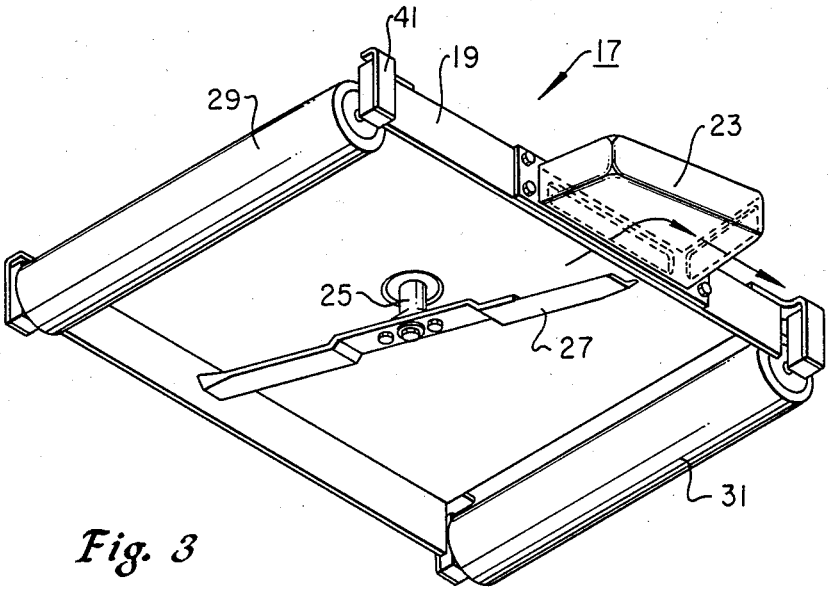
FIG. 3 is a perspective view of the lower side of the mower of FIG. 1.

Mower 17 is a type of a mower that will have a downward facing housing 19. A drive means 21 will be mounted to the upper side of the housing 19. Alternately, the mower 17 could be pulled by a tractor, which also serves as a drive means. A chute 23 extends out the side of the housing 19 for discharging clippings. As shown in FIG. 3, the drive means 21 rotates a vertical drive shaft 25. Drive shaft 25 rotates a blade 27 which is horizontal and has generally flat ends for cutting the grass as the blade 27 rotates in a generally horizontal plane.

A guard member or front guard roller 29 will be mounted to the forward end of housing 19. A rear guard roller 31 will be mounted to the rearward end of the housing 19. Each roller 29, 31 is a cylindrical member that extends completely across the width of the housing 19. Each roller 29, 31 is oriented perpendicular to the direction of travel of the housing 19. The width of each roller 29, 31 is slightly greater than the width of the blade 27.

Figure 4:
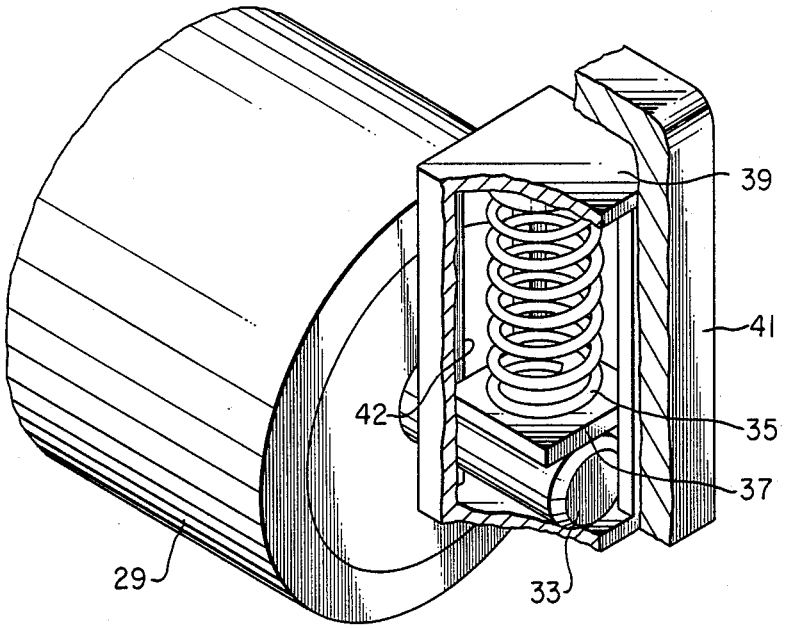
FIG. 4 is an enlarged perspective view illustrating one of the mounts for one of the rollers of the mower of FIG. 1.

As shown in FIG. 4, each roller 29, 31 has bearings (not shown) which rotate on an axle 33. The axle 33 is urged downward by a spring 35. A plate 37 locates between the spring 35 and axle 33. The spring 35, plate 37, and the end of the axle 33 locate within a mounting body 39. A mounting bracket 41 secures the mounting body 39 to the housing 19. The end of the axle 33 extends in a longitudinal slot 42 in the body 39. This allows the axle 33 to move up and down within the slot 42 to accommodate uneven terrain. The rollers 29, 31 support the mower 17 for rolling contact with the ground 13.

Figure 2:
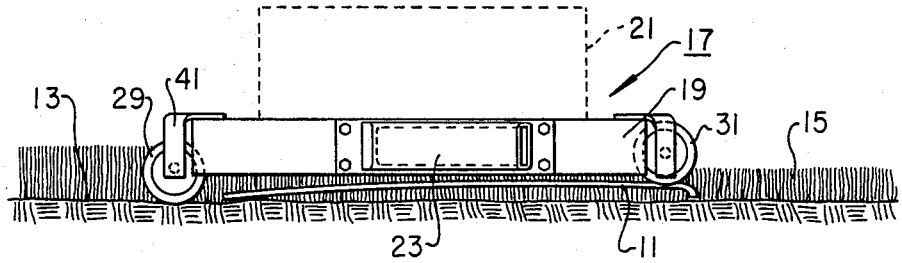
FIG. 2 is a schematic side elevational view of the mower of FIG. 1, showing the marker in a horizontal position underneath the mower.

The distance between the axles 33 of the rollers 29, 31 is less than the height that the marker 11 protrudes above the ground 13. As shown in FIG. 2, this is necessary so that when the upper end of the marker 11 is released from its contact with the front roller 29, the rear roller 31 will already be a significant distance on the marker 11. The rear roller 31 prevents the marker 11 from springing back up after the front roller 29 passes from it.

In operation, mower 17 will move directly into contact with marker 11. The front roller 29 will cause the marker 11 to bend at its base. The front roller 29 will roll on top of the marker 11, causing it to assume a prone position, substantially flush with the ground. The weight of the mower 17 will hold the marker 11 in the horizontal position as the blade 27 passes over it. Before the front roller 29 releases its contact with the marker 11, the rear roller 31 will also roll onto the marker 11. As the front roller 29 releases contact, the rear roller 31 will be on the marker 11 a distance sufficient enough to maintain it in the prone position. This prevents the marker 11 from flexing up into contact with the blade 27. Once the rear roller 31 leaves the marker 11, it will spring back to the vertical position shown in FIG. 1.

Figure 5:
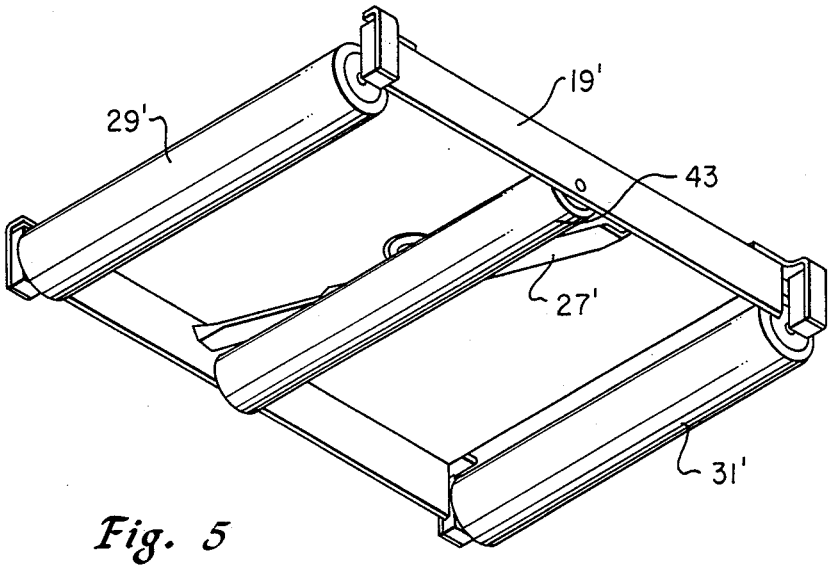
FIG. 5 is a schematic lower perspective view illustrating a second embodiment of a mower constructed in accordance with this invention.

In the embodiment of FIG. 5, the housing 19' has the same front and rear rollers 29', 31'. In addition, it has an intermediate roller 43. The intermediate roller 43 is located parallel to the front and rear rollers 29', 31'. It is located halfway between the front and rear rollers 29', 31' and substantially underneath the shaft (not shown) of the blade 27'. The intermediate roller 43 will serve to maintain the marker 11 prone in the case of markers which are not greater in length than the longitudinal distance between the front and rear rollers 29', 31'.

Figure 6:
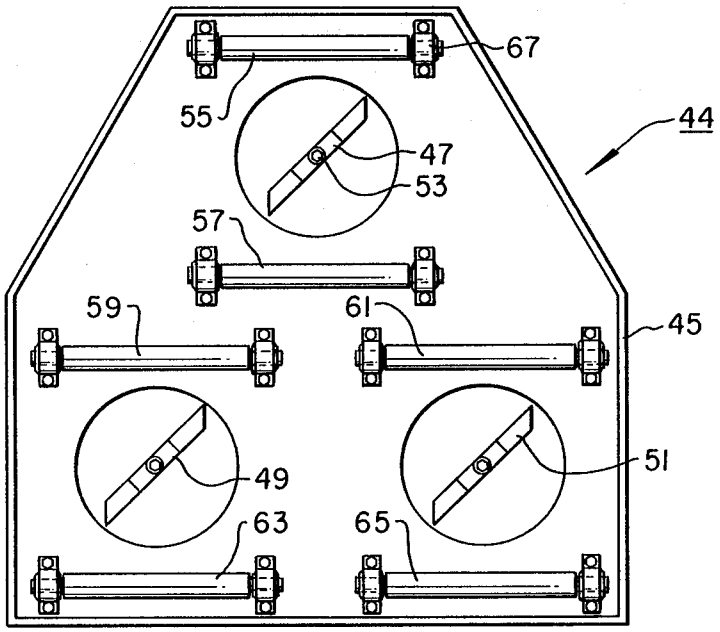
FIG. 6 is a bottom plan view of a third embodiment of a mower constructed in accordance with this invention.

In the embodiment of FIG. 6, the same principle is applied to a gang-type mower 44. Mower 44 has a housing 45. Housing 45 will contain a number of blades rather than just one. In the embodiment shown, there is an offset blade 47 which is located in the forward portion of the housing 45. Aligned blades, 49, 51 are located in the rearward portion of the housing 45. The aligned blades 49 each are located on a line perpendicular to the longitudinal axis of the housing 45. The offset blade 47 is located forward of the aligned blades 49, 51. It is located on the longitudinal axis. The aligned blades 49, 51 are laterally spaced apart from each other in a direction perpendicular to the longitudinal axis of housing 45. The offset blade 47 will be located forward of and equidistant between the aligned blades 49, 51, overlapping slightly at the edges.

Each of the blades 47, 49, 51 is mounted on a vertical drive shaft 53, which rotates the blades 47, 49, and 51 in horizontal planes. A front roller 55 locates just forward of the cutting tip of the offset blade 47. A rear roller 57 locates just rearward of the cutting tip of offset blade 47. A front roller 59 locates immediately forward of the cutting tip of aligned blade 49. A front roller 61 locates immediately forward of the cutting tip of aligned blade 51. The rollers 59, 61 are located rearward of the cutting tip of rear roller 57. A rear roller 63 locates immediately rearward of the aligned blade 49. A rear roller 65 locates immediately rearward of the aligned blade 51.

Figure 7:
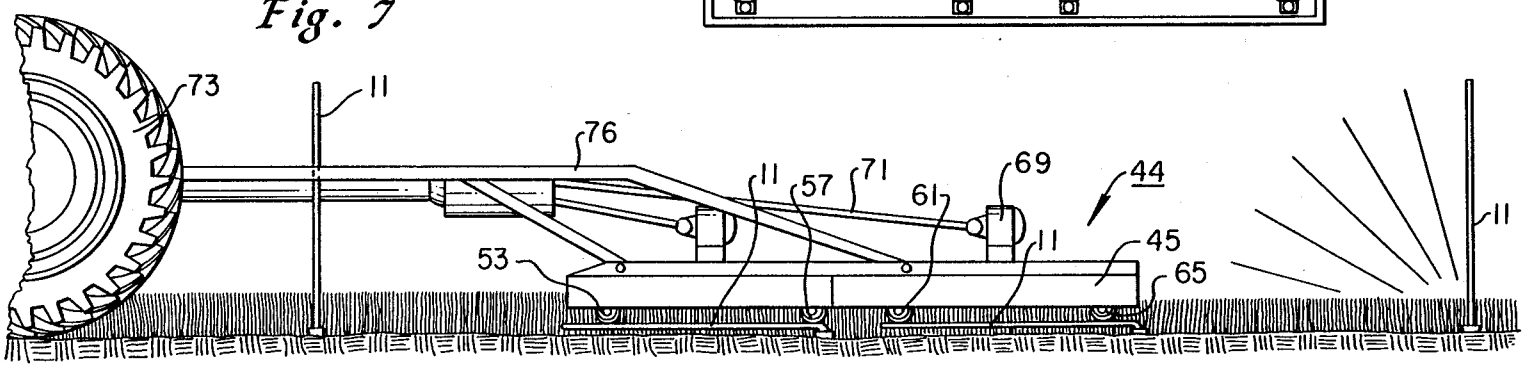
FIG. 7 is a schematic side elevational view of the mower of FIG. 6.

The axial width of each roller 55, 57, 59, 61, 63, 65 is only slightly greater than the width of each blade 47, 49, 51. Each roller 55, 57, 59, 61, 63, 65 is connected to a rotatable mount 67 which is similar to the mount shown in FIG. 4. Each of the rollers 55, 57, 59, 61, 63, 65 will contact the ground and support the housing 45 for rolling contact with the ground. As shown in FIG. 7, each of the blades 47, 49, 51 has a drivehead 69 which is connected by a drive shaft 71 to a tractor 73. A tow bar 76 will connect the housing 45 to the tractor 73.

In the operation of the embodiment of FIGS. 6 and 7, the rollers 55, 59, and 61 overlap each other such that regardless of alignment, if the mower 44 passes over a marker 11, one of the rollers 55, 59, 61 will cause it to deflect downward. The rear rollers 57, 63 and 65 are spaced closely enough to the front rollers 55, 59, 61 respectively, so as to contact the prone markers 11 before they are released from one of the front rollers. This avoids the marker 11 from springing up into contact with one of the blades 47, 49 or 51.

Figure 8:
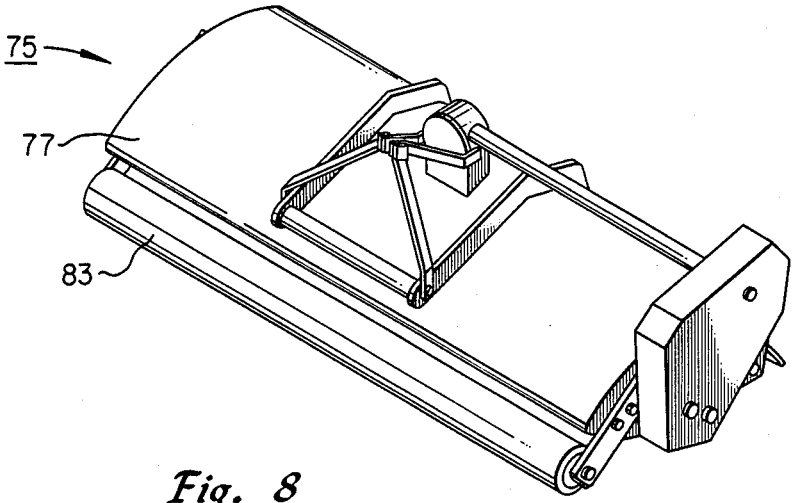
FIG. 8 is a perspective view of a third embodiment of a mower constructed in accordance with this invention.
Figure 9:
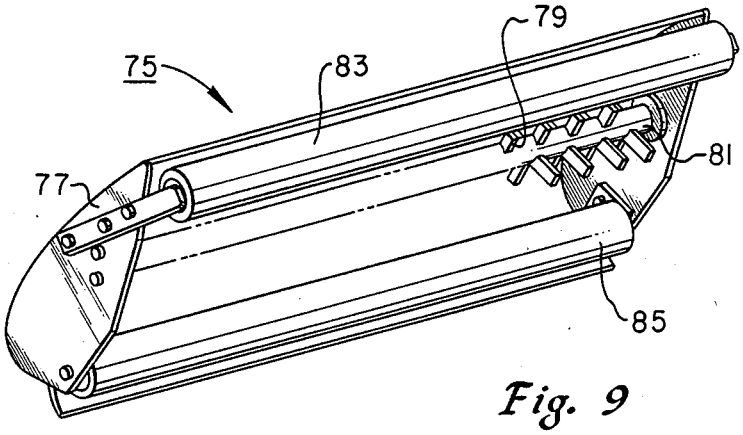
FIG. 9 is a bottom perspective view of the mower of FIG. 8.
Figure 10:
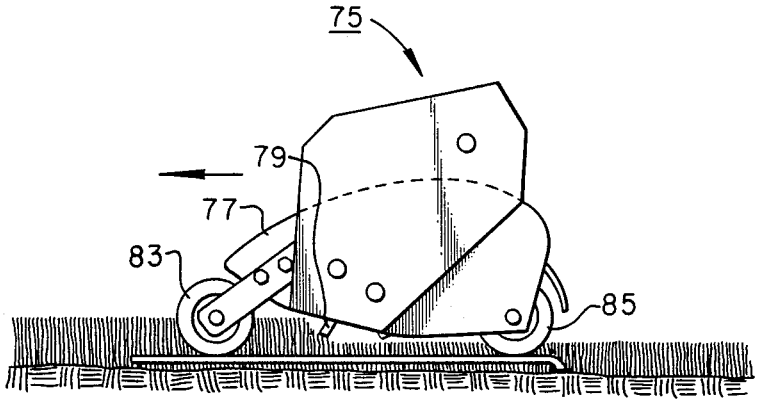
FIG. 10 is a side elevational view of the mower of FIG. 8.

In the embodiment of FIGS. 8–10, a flail-type mower 75 is shown. Flail mower 75 is a conventional type of mower having a housing 77. A plurality of cutting elements 79 are mounted to a horizontal shaft 81. The cutting elements 79 are sharp discs or blades that rotate in vertical planes as the shaft 81 rotates.

The guard means for flail mower 75 will comprise a front roller 83 and a rear roller 85. Rollers 83, 85 will extend the full width of the shaft 81. The rollers 83, 85 are solid cylindrical members that support the housing 77 in rolling contact with the ground. As shown in FIG. 10, the longitudinal spacing between the rollers 83, 85 is less than the height of the marker 11. This assures that the rear roller 85 will be holding the marker 11 down as the front roller 83 passes from the upper end of the marker 11.

The invention has significant advantages. The guard members will force a flexible marker down and hold the marker down as the mower housing passes over it. The guard members prevent the marker from springing back into contact with a blade which would otherwise damage it. These guard members allow mowers with rotary and flail-type blades to be used without having to trim around a marker.

While the invention has been shown in only four of its forms, it should be apparent to those skilled in the art that it is not so limited but is susceptible to various changes without departing from the scope of the invention.

I claim:

1. A mowing apparatus for mowing grass in a grassy area having at least one flexible, resilient marker inserted into the ground of a type which will bend substantially flush with the ground, comprising in combination:

a blade housing having a longitudinal axis parallel to a direction of travel of the housing;

at least one blade carried in and rotatably driven in the housing;

a front guard roller located forward of the blade and a rear guard roller located rearward of the blade, each guard roller extending transversely to the longitudinal axis of the housing at least the full width of the blade; and mounting means for mounting the guard rollers rotatably to the housing so as to contact and bend the marker, and for spacing the guard rollers apart from each other in a longitudinal direction a distance less than the height that the marker protrudes above the ground, so as to prevent the marker from flexing upward into contact with the blade as the mower travels over it.

2. The apparatus according to claim 1 wherein each guard roller has a solid cylindrical exterior.

3. The apparatus according to claim 1 further comprising spring means on each end of each guard roller for allowing each guard roller to move vertically a short distance and for urging each guard roller downward.

4. The apparatus according to claim 1 wherein each blade is mounted to a vertical drive shaft for rotation in a horizontal plane.

5. The apparatus according to claim 1 wherein the mower has a plurality of the blades, each of the blades being mounted to a vertical drive shaft for rotation in a horizontal plane, and wherein one of the front and rear guard rollers is mounted in front of and rearward of each of the blades.

6. The apparatus according to claim 1 wherein the blade comprises a flail type member mounted to a shaft extending perpendicular to the longitudinal axis of the housing.

7. A mowing apparatus for mowing grass in a grassy area having at least one flexible, resilient marker inserted into the ground of a type which will bend substantially flush with the ground, comprising in combination:

a blade housing having a longitudinal axis parallel to a direction of travel of the housing;

at least one blade carried in and rotatably driven in the housing; and a front guard roller and a rear guard roller; and means for mounting the front guard roller forward of the blade and the rear guard roller rearward of the blade, transverse to the longitudinal axis of the housing and supporting the housing for rolling on the ground, each of the front and rear guard rollers having a width that is at least the full width of the blade, the guard rollers being spaced apart from each other in a longitudinal direction a distance selected so as to prevent the flexible marker from flexing upward into contact with the blade as the mower travels over it.

8. The apparatus according to claim 7 further comprising an intermediate guard roller mounted below the blade.

9. The apparatus according to claim 7 wherein the mower has a plurality of blades, each of the blades being mounted to a vertical drive shaft for rotation in a horizontal plane, the drive shafts being spaced apart from each other in directions transverse to the longitudinal axis of the housing, at least one of the drive shafts being spaced from the other of the drive shafts in a longitudinal direction, and wherein a separate one of the front and rear guard rollers is mounted in front of and rearward of each of the blades.

10. The apparatus according to claim 7 wherein the blade comprises a flail type member mounted to a shaft extending perpendicular to the longitudinal axis of the housing.

11. A mowing apparatus, comprising in combination:

a blade housing having a longitudinal axis parallel to a direction of travel of the housing;

two aligned blades and one offset blade carried in and rotatably driven in the housing, each of the blades having a rotatably driven vertical shaft for rotating the blade in a horizontal plane, the aligned blades being in alignment with each other in a direction perpendicular to the longitudinal axis of the housing, the offset blade being spaced from the aligned blades in a longitudinal direction and spaced between the aligned blades in a direction transverse to the longitudinal axis; and a plurality of guard members spaced forward and rearward of the blades, each guard member comprising a solid surface extending perpendicular to the longitudinal axis at least the width of one of the blades and extending downward to a point below the blades, at least one of the guard members being located longitudinally between the aligned blades and the offset blade.

12. The apparatus according to claim 11 wherein each of the guard members comprises a cylindrical roller.

13. The apparatus according to claim 11 wherein each of the guard members comprises a cylindrical roller that is mounted for rolling contact with the ground.

14. The apparatus according to claim 11 wherein the offset blade is located forward of the aligned blades and wherein one of the guard members is located immediately rearward of the offset blade and forward of the aligned blades, and two of the guard members are located forward of the aligned blades and two of the guard members are located rearward of the offset blade.

15. A method of mowing grass in a grassy area which has at least one marker inserted into the ground, comprising in combination:

providing the marker with a shaft which is resilient and which will flex sufficiently to allow the marker to bend over substantially flush with the ground;

providing a mower with a blade housing having a longitudinal axis parallel to a direction of travel of the housing and at least one blade carried in and rotatably driven in the housing;

mounting a front guard member to the housing forward of the blade and a rear guard member to the housing rearward of the blade, with each guard member extending transverse to the longitudinal axis of the housing at least the full width of the blade, and mounting the guard members to the housing so as to contact the marker substantially at a point where the marker enters the ground, and spacing the guard members apart from each other in a longitudinal direction a distance less than the height that the marker protrudes above the ground;

rotating the blade and moving the housing over the grassy area;

contacting the shaft of the marker with the front guard member, and moving the housing over the marker, causing the marker to bend over substantially flush with the ground to avoid being struck by the blade; then contacting the shaft in its bent over position with the rear guard member as the housing continues to move over the marker, maintaining the shaft in its bent over position as the front guard member passes from the marker, so as to prevent the marker from flexing upward into contact with the blade as the mower travels over it.

* * * * *